US009304456B2

(12) United States Patent
Nakano

(10) Patent No.: US 9,304,456 B2
(45) Date of Patent: Apr. 5, 2016

(54) FIXING DEVICE FIXING A TONER IMAGE ON A RECORDING MEDIUM AND IMAGE FORMING APPARATUS INCLUDING THE SAME

(71) Applicant: KYOCERA Document Solutions Inc., Osaka (JP)

(72) Inventor: Kuniaki Nakano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/451,944

(22) Filed: Aug. 5, 2014

(65) Prior Publication Data

US 2015/0063883 A1 Mar. 5, 2015

(30) Foreign Application Priority Data

Aug. 28, 2013 (JP) ..... 2013-176233

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/0253; G03G 2215/2035; G03G 2215/2038
USPC ..... 399/329
See application file for complete search history.

(56) References Cited

U.S. PATENT DOCUMENTS

| | | | | |
|---|---|---|---|---|
| 7,437,110 | B2 * | 10/2008 | Kondo et al. | |
| 8,744,330 | B2 | 6/2014 | Yoshinaga et al. | |
| 2008/0112739 | A1 * | 5/2008 | Shinshi | 399/329 |
| 2008/0292372 | A1 * | 11/2008 | Han | |
| 2013/0064586 | A1 * | 3/2013 | Adachi et al. | 399/329 |
| 2014/0079424 | A1 * | 3/2014 | Ikebuchi | |
| 2015/0030362 | A1 * | 1/2015 | Bae et al. | 399/329 |

FOREIGN PATENT DOCUMENTS

JP 2011-186133 A 9/2011

* cited by examiner

*Primary Examiner* — Walter L Lindsay, Jr.
*Assistant Examiner* — Milton Gonzalez
(74) *Attorney, Agent, or Firm* — Studebaker & Brackett PC

(57) ABSTRACT

A fixing device includes a fixing belt, a pressuring member, a heating source, a heat conducting member and a reflecting member. The fixing belt is arranged rotatably. The pressuring member is arranged outside the fixing belt and comes into pressure contact with the fixing belt to form a fixing nip. The heating source is arranged inside the fixing belt to emit radiant heat. The heat conducting member comes into contact with an inner circumference face of the fixing belt and absorbs the radiant heat emitted from the heating source. The reflecting member includes a reflecting part and a nip forming part. The reflecting part reflects the radiant heat emitted from the heating source toward the heat conducting member. The nip forming part is unified with the reflecting part and comes into contact with the inner circumference face of the fixing belt to press the fixing belt to the pressuring member.

10 Claims, 2 Drawing Sheets

FIXING DEVICE FIXING A TONER IMAGE ON A RECORDING MEDIUM AND IMAGE FORMING APPARATUS INCLUDING THE SAME

INCORPORATION BY REFERENCE

This application is based on and claims the benefit of priority from Japanese Patent application No. 2013-176233 filed on Aug. 28, 2013, the entire contents of which are incorporated herein by reference.

BACKGROUND

The present disclosure relates to a fixing device fixing a toner image on a recording medium and an image forming apparatus including the fixing device.

An electrographic image forming apparatus, such as a copying machine or a printer, includes a fixing device fixing a toner image on a recording medium, such as a sheet. In the fixing device, various manners are applied. As a general manner, a so-called "heat roller manner" is cited, in which the heat roller stores a heating source inside and a fixing nip is formed by making the heat roller come into pressure contact with a pressuring member. The fixing device in the heat roller manner heats and pressures the toner image and recording medium by the fixing nip formed between the heat roller and pressuring member to fix the toner image on the recording medium.

On the other hand, recently, in order to make the image forming apparatus conform to a standard or a regulation regarding saving energy, shortening of a warm-up time and reduction of electric power during operation are required for the fixing device. About this point, in the above-mentioned heat roller manner, because strength to endure the forming of the fixing nip is required for the heat roller, thickness of the heat roller must be thickened, and accordingly, thermal capacity becomes large as a result.

Therefore, a so-called "belt manner" fixing device is developed, in which a fixing nip is formed by using a fixing belt having a thinner thickness and smaller thermal capacity than the heat roller. For example, there is a fixing device includes the fixing belt, a pressuring member, a nip forming member, a supporting member, a heating source and a heat conducting member. The pressuring member comes into pressure contact with the fixing belt to form the fixing nip. The nip forming member presses the fixing belt to a side of the pressuring member. The supporting member supports the nip forming member. The heating source is arranged inside the fixing belt. The heat conducting member comes into contact with an inner circumference face of the fixing belt.

In the above-mentioned technique, in a case where the heating source faces to the supporting member, a part of radiant heat emitted from the heating source is absorbed by the supporting member and lost from the supporting member to the outside of the fixing device. Therefore, because the heating source cannot intensively heat the heat conducting member, heat conduction efficiency from the heat conducting member to the fixing belt is lowered, and accordingly, it is difficult to efficiently heat the fixing belt.

SUMMARY

In accordance with an embodiment of the present disclosure, a fixing device includes a fixing belt, a pressuring member, a heating source, a heat conducting member and a reflecting member. The fixing belt is arranged rotatably. The pressuring member is arranged outside the fixing belt and comes into pressure contact with the fixing belt to form a fixing nip. The heating source is arranged inside the fixing belt to emit radiant heat. The heat conducting member comes into contact with an inner circumference face of the fixing belt and absorbs the radiant heat emitted from the heating source. The reflecting member includes a reflecting part and a nip forming part. The reflecting part reflects the radiant heat emitted from the heating source toward the heat conducting member. The nip forming part is unified with the reflecting part and comes into contact with the inner circumference face of the fixing belt to press the fixing belt to a side of the pressuring member.

In accordance with an embodiment of the present disclosure, an image forming apparatus includes a fixing device. The fixing device includes a fixing belt, a pressuring member, a heating source, a heat conducting member and a reflecting member. The fixing belt is arranged rotatably. The pressuring member is arranged outside the fixing belt and comes into pressure contact with the fixing belt to form a fixing nip. The heating source is arranged inside the fixing belt to emit radiant heat. The heat conducting member comes into contact with an inner circumference face of the fixing belt and absorbs the radiant heat emitted from the heating source. The reflecting member includes a reflecting part and a nip forming part. The reflecting part reflects the radiant heat emitted from the heating source toward the heat conducting member. The nip forming part is unified with the reflecting part and comes into contact with the inner circumference face of the fixing belt to press the fixing belt to a side of the pressuring member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
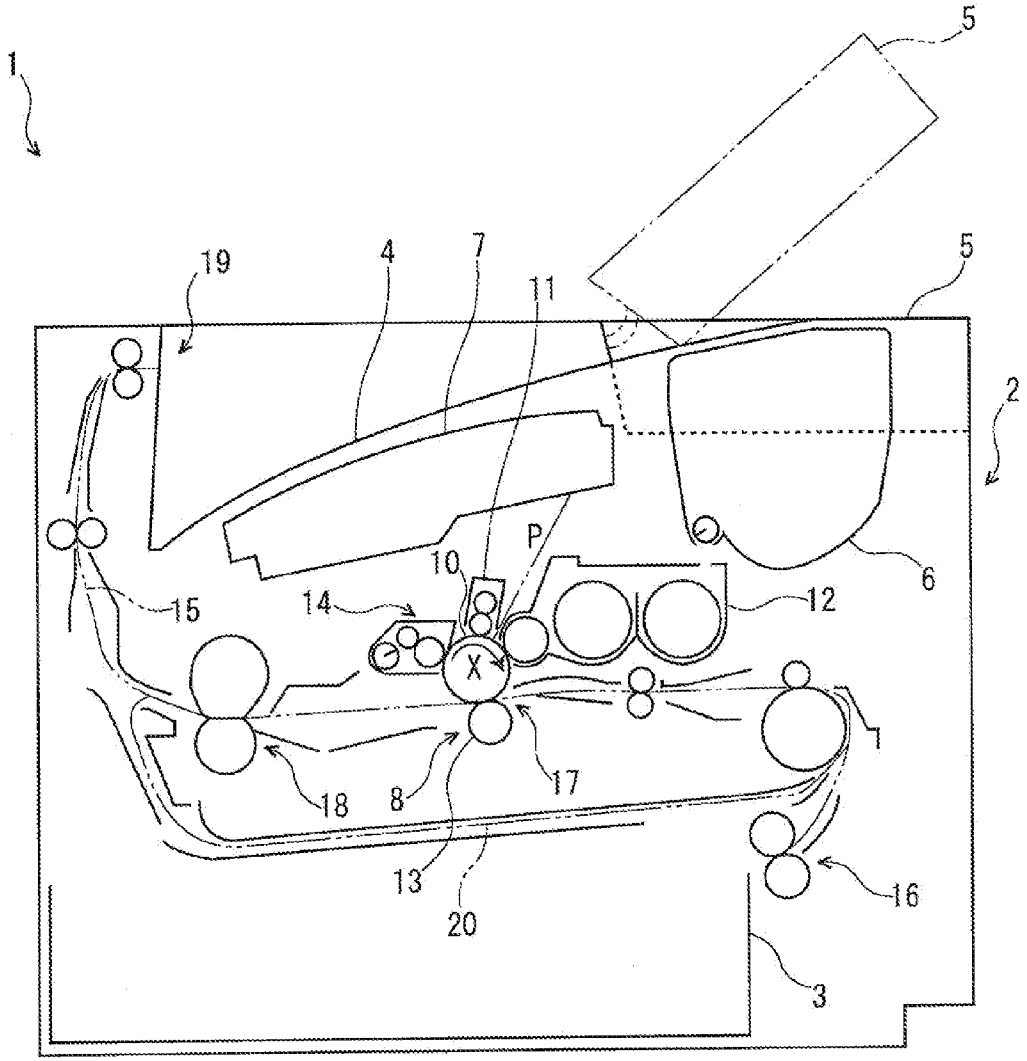
FIG. 1 is a schematic diagram schematically showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to go forward to the fixing device 18, and then, the toner image is fixed on the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described with reference to FIG. 2. Hereinafter, it will be described so that the front side of the fixing device 18 is positioned at the near side of FIG. 2, for convenience of explanation.

Figure 2:
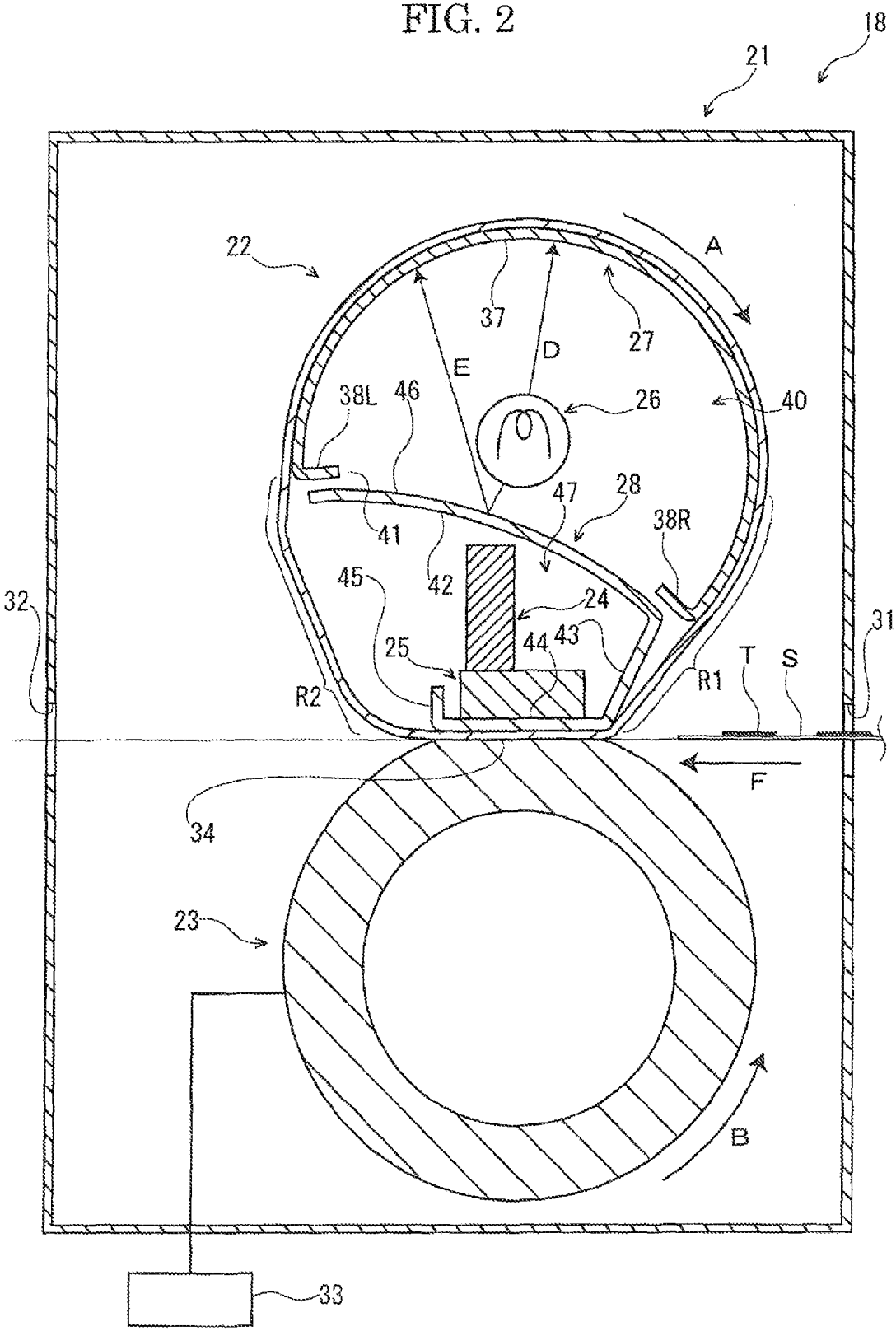
FIG. 2 is a sectional view showing a fixing device of the printer according to the embodiment of the present disclosure.

As shown in FIG. 2, the fixing device 18 includes a box-like formed fixing frame 21, a fixing belt 22, a pressuring roller 23 (a pressuring member), a supporting member 24, a heat insulating member 25, a heater 26 (a heating source), a heat conducting member 27 and a reflecting member 28. The fixing belt 22 is installed in an upper part of the fixing frame 21. The pressuring roller 23 is installed in a lower part of the fixing frame 21 and positioned below (outside) the fixing belt 22. The supporting member 24 is positioned in a lower part inside the fixing belt 22. The heat insulating member 25 is positioned below the supporting member 24 inside the fixing belt 22. The heater 26 is positioned in an upper part inside the fixing belt 22. The heat conducting member 27 is arranged from an upper side to both left and right sides over the heater 26 inside the fixing belt 22. The reflecting member 28 is positioned below the heater 26 inside the fixing belt 22.

In a right end part of the fixing frame 21, an inlet opening part 31 is formed. In a left end part of the fixing frame 21, an outlet opening part 32 is formed. The sheet S is introduced via the inlet opening part 31 into the fixing frame 21, and then, led out via the outlet opening part 32 from the fixing frame 21.

The fixing belt 22 is arranged rotatably in a predetermined rotating direction (refer to an arrow A in FIG. 2). The fixing belt 22 is an endless belt and is formed in a cylindrical shape elongated in forward and backward directions. The fixing belt 22 is composed of, for example, a base material layer, an elastic layer provided around the base material layer and a release layer covering the elastic layer. The base material layer of the fixing belt 22 is made of, for example, metal, such as steel special use stainless (SUS), nickel or copper. The elastic layer of the fixing belt 22 is made of, for example, a silicone rubber. The release layer of the fixing belt 22 is made of, for example, a fluorine-based resin, such as perfluoro alkoxy alkane (PFA).

The pressuring roller 23 is formed in a cylindrical shape elongated in the forward and backward directions. The pressuring roller 23 is composed of, for example, a cylindrical core member, an elastic layer provided around the core member and a release layer covering the elastic layer. The core member of the pressuring roller 23 is made of, for example, metal, such as stainless or aluminum. The elastic layer of the pressuring roller 23 is made of, for example, a silicone rubber or a silicone sponge. The release layer of the pressuring roller 23 is made of, for example, a fluorine-based resin, such as PFA.

The pressuring roller 23 is rotatably supported by the fixing frame 21. The pressuring roller 23 is connected to a drive source 33 composed of a motor or the like. The pressuring roller 23 comes into pressure contact with the fixing belt 22 and a fixing nip 34 is formed between the fixing belt 22 and pressuring roller 23. Hereinafter, the terms of an "upstream side from the fixing nip 34" and a "downstream side from the fixing nip 34" respectively indicate an upstream side and a downstream side from the fixing nip 34 in the rotating direction (refer to the arrow A in FIG. 2) of the fixing belt 22.

The supporting member 24 is formed in a shape elongated in the forward and backward directions. The supporting member 24 has a vertically elongated rectangular section. The supporting member 24 is made of, for example, a metal plate. Both front and rear end parts of the supporting member 24 are attached to the fixing frame 21.

The heat insulating member 25 is formed in a shape elongated in the forward and backward directions. The heat insulating member 25 has a horizontally elongated rectangular section. The heat insulating member 25 is made of, for example, a heat resistant resin, such as liquid crystal polymer (LCP), or a heat resistant fiber, such as alamido fiber. A top face of the heat insulating member 25 is fixed to a lower face of the supporting member 24.

The heater 26 is formed in a shape elongated in the forward and backward directions. The heater 26 is composed of, for example, a halogen lamp. The heater 26 is configured to generate heat by energization and to emit radiant heat.

The heat conducting member 27 is formed in a shape elongated in the forward and backward directions. The heat conducting member 27 is placed in a posture inclined to the right side (the upstream side from the fixing nip 34). The heat conducting member 27 is made of, for example, metal having electric conductivity, such as aluminum. The heat conducting member 27 is directly fixed to the fixing frame 21 or fixed to the fixing frame 21 via the supporting member 24.

Onto an inner circumference face (a face facing to the heater 26) of the heat conducting member 27, a heat resistant black coating with high heat absorptivity is applied. Thereby, the heat conducting member 27 is configured to be capable of efficiently absorbing the radiant heat emitted from the heater 26. As the heat resistant black coating applied onto the inner circumference face of the heat conducting member 27, Okitsumo (product name), thermoblack (product name) or the like may be used.

The heat conducting member 27 has a curved part 37 curved upwardly (to a side separating from the fixing nip 34) in an arc-like shape and bent parts 38R and 38L bent from both left and right end parts of the curved part 37 to an internal diameter side.

The curved part 37 is arranged so as to cover equal to or more than half of the heater 26 in a circumferential direction (in the embodiment, a range a little more than half of the heater 26 in the circumferential direction). An outer circumference face of the curved part 37 comes into contact with the inner circumference face of the fixing belt 22. Inside the curved part 37, a storage space 40 is provided, and the heater 26 is stored in the storage space 40. In the storage space 40, an opening part 41 opened to a lower side (a side of the fixing nip 34) is arranged.

The bent parts 38R and 38L of the heat conducting member 27 are positioned at both sides of the opening part 41 of the storage part 40. The right bent part 38R is arranged in one end part at the right side (the upstream side from the fixing nip 34) of the heat conducting member 27 and the left bent part 38L is arranged in another end part at the left side (the downstream side from the fixing nip 34) of the heat conducting member 27. The right bent part 38R is closer to the fixing nip 34 than the left bent part 38L.

The reflecting member 28 is formed in a shape elongated in the forward and backward directions. The reflecting member 28 is placed in a posture inclined to the right side (the upstream side from the fixing nip 34). The reflecting member 28 is made of one metal plate. The reflecting member 28 is made of a material (for example, bright aluminum) to which surface treatment to improve a gloss is applied.

The reflecting member 28 has a reflecting part 42, a connecting part 43, a nip forming part 44 and a folded part 45. The connecting part 43 is bent from a right end part of the reflecting part 42 to the left lower side (the side of the fixing nip 34). The nip forming part 44 is bent from a lower end part of the connecting part 43 to the left side. The folded part 45 is folded from a left end part (an end part at a side separating from the connecting part 43) of the nip forming part 44 to the upper side (the internal diameter side).

The reflecting part 42 is inclined so as to be gradually close to the fixing nip 34 from the left side (the downstream side from the fixing nip 34) to the right side (the upstream side from the fixing nip 34). The reflecting part 42 is arranged so as to cover the opening part 41 of the storage space 40 of the heat conducting member 27. Both left and right end parts of the reflecting part 42 face to the respective bent parts 38L and 38R of the heat conducting member 27 at slight distances. The reflecting part 42 is slightly curved upwardly (to the side separating from the fixing nip 34). On a top face (a face facing to the heater 26) of the reflecting part 42, a reflecting face 46 is formed.

The connecting part 43 is formed in a flat plate shape. The connecting part 43 connects a right end part (an end part at the upstream side from the fixing nip 34) of the reflecting part 42 and a right end part (an end part at the upstream side from the fixing nip 34) of the nip forming part 44.

The nip forming part 44 is formed in a roughly horizontally flat plate shape. The nip forming part 44 is unified with the reflecting part 42 via the connecting part 43. The nip forming part 44 comes into contact with the inner circumference face of the fixing belt 22 to press downwardly (to a side of the pressuring roller 23) the fixing belt 22. It is configured so that the fixing belt 22 is slid onto the nip forming part 44 when the fixing belt 22 is rotated. That is, the fixing device 18 of the embodiment is a so-called "sliding belt manner".

An upper face of the nip forming part 44 is fixed to a lower face of the heat insulating member 25. The nip forming part 44 is supported by the supporting member 24 via the heat insulating member 25. In other words, the heat insulating member 25 is interposed between the nip forming part 44 and supporting member 24.

Inside the reflecting member 28, a space 47 surrounded by the reflecting part 42, nip forming part 44 and connecting part 43 is arranged. The space 47 is opened to the left side (the downstream side of the fixing nip 34). In the space 47, the supporting member 24 and heat insulating member 25 are stored.

In the fixing device 18 configured as described above, in order to fix the toner image onto the sheet S, the drive source 33 works to rotate the pressuring roller (refer to an arrow B in FIG. 2). When the pressuring roller 23 is thus rotated, the fixing belt 22 coming into pressure contact with the pressuring roller 23 is co-rotated in an opposite direction to the pressuring roller 23 (refer to the arrow A in FIG. 2).

When the pressuring roller 23 and fixing belt 22 are thus rotated, in an area R1 at the upstream side from the fixing nip 34, since the fixing belt 22 is pulled to the side of the fixing nip 34, the fixing belt 22 tends to be strained (the tension of the fixing belt 22 becomes high). On the other hands, in an area R2 at the downstream side from the fixing nip 34, since the fixing belt 22 is released from the fixing nip 34, the fixing belt 22 tends to be loosened (the tension of the fixing belt 22 becomes low). That is, the upstream side from the fixing nip 34 is a side having a tendency to strain the fixing belt 22 and the downstream side from the fixing nip 34 is a side having a tendency to loosen the fixing belt 22.

Moreover, in order to fix the toner image onto the sheet S, the heater 26 is activated (lighted). When the heater 26 is thus activated, the heater 26 emits the radiant heat. The radiant heat emitted from the heater 26 to the heat conducting member 27 directly reaches, as indicated by an arrow D in FIG. 2, the inside face of the heat conducting member 27 and is absorbed by the heat conducting member 27. The radiant heat emitted from the heater 26 to the supporting member 24 is reflected, as indicated by an arrow E in FIG. 2, toward the heat conducting member 27 by the reflecting face 46 of the reflecting part 42 of the reflecting member 28, reaches the inside face of the heat conducting member 27 and is absorbed by the heat conducting member 27.

In accordance with the above-mentioned action, the heat conducting member 27 is heated, and simultaneously, the fixing belt 22 is heated by heat conduction from the heat conducting member 27. In such a condition, as indicated by an arrow F in FIG. 2, when the sheet S is conveyed to the fixing nip 34, the sheet S and toner image T are heated and pressured, and accordingly, the toner image T is fixed onto the sheet S.

Incidentally, the reflecting face 46 of the reflecting part 42 of the reflecting member 28 may incompletely reflect the radiant heat emitted from the heater 26 regardless of the surface treatment to improve the gloss and a part of the radiant heat emitted from the heater 26 may be absorbed by the reflecting part 42 of the reflecting member 28. In addition, when the heater 26 is activated as mentioned above, ambient temperature of the reflecting member 28 is raised. Due to these reasons, if the temperature of the reflecting member 28 is raised as the time elapses, the heat may be lost to the outside of the fixing device 18 via a connecting member to the reflecting member 28. If the heat were lost to the outside of the fixing device 18, there would be possibilities that heating efficiency of the fixing belt 22 is lowered in accordance with increase of heat loss and that the temperature outside of the fixing device 18 is raised.

However, in the reflecting member 28 in the embodiment, since the nip forming part 44 coming into contact with the inner circumference face of the fixing belt 22 is unified with the reflecting part 42, even if the part of the radiant heat emitted from the heater 26 is absorbed by the reflecting part 42, it is possible to conduct the radiant heat absorbed by the reflecting part 42 to the fixing belt 22 via the nip forming part 44. Therefore, it is possible to prevent the heat from being lost to the outside of the fixing device 18. Accordingly, it is possible to restrain the heating efficiency of the fixing belt 22 from being lowered in accordance with the increase of the heat loss and to restrain the temperature outside of the fixing device 18 from being raised.

Moreover, as described above, the radiant heat emitted from the heater 26 to the supporting member 24 can be reflected toward the heat conducting member 27 by the reflecting face 46 of the reflecting part 42. Therefore, it is possible to restrain the radiant heat emitted from the heater 26 from being absorbed by the supporting member 24 and to intensively heat the heat conducting member 27. Accordingly, it is possible to improve heat conduction efficiency from the heat conducting member 27 to the fixing belt 22 and to efficiently heat the fixing belt 22.

Further, since it is configured that the nip forming part 44 forming the fixing nip 34 is used for conducting the radiant heat absorbed by the reflecting part 42 to the fixing belt 22, it is unnecessary to separately add another member for the heat conduction from the reflecting part 42 to the fixing belt 22. Therefore, it is possible to simplify the configuration of the fixing device 18. In addition, by carrying out the heat conduction from the reflecting part 42 to the fixing belt 22 by using the nip forming part 44, it is possible to intensively heat the fixing nip 34.

The heat conducting member 27 is arranged so that the right bent part 38R (an end part at the upstream side from the fixing nip 34) is closer to the fixing nip 34 than the left bent part 38L (an end part at the downstream side from the fixing nip 34) and the reflecting part 42 is inclined so as to be gradually close to the fixing nip 34 from the left side (the downstream side from the fixing nip 34) to the right side (the upstream side from the fixing nip 34). By applying such a configuration, the heat conducting member 27 is likely to come into close contact with the fixing belt 22 and it is possible to further improve the heat conduction efficiency from the heat conducting member 27 to the fixing belt 22.

By supporting the nip forming part 44 by the supporting member 24, it is possible to restrain the nip forming part 44 from being deformed. By interposing the heat insulating member 25 between the nip forming part 44 and supporting member 24, it is possible to restrain the heat conduction from the nip forming part 44 to the supporting member 24, and accordingly, to prevent the heat from being lost from the supporting member 24 to the outside of the fixing device 18. Therefore, it is possible to restrain the heating efficiency of the fixing belt 22 from being lowered in accordance with the increase of the heat loss and to restrain the temperature outside of the fixing device 18 from being raised.

The supporting member 24 and heat insulating member 25 are stored in the space surrounded by the reflecting part 42, nip forming part 44 and connecting part 43. By applying such a configuration, it is possible to effectively use the space provided by the reflecting member 28 as an installation space of the supporting member 24 and heat insulating member 25, and accordingly, to make the fixing device 18 compact.

The heat conducting member 27 has the storage space 40 storing the heater 26 and the storage space 40 has the opening part 41 opened to the lower side (the side of the fixing nip 34), and then, the reflecting part 42 is arranged so as to cover the opening part 41. By applying such a configuration, it is possible to arrange the heater inside the storage space 40 with high sealability surrounded by the heat conducting member 27 and reflecting part 42. According to this, it is possible to more intensively heat the heat conducting member 27 by the heater 26, and then, to further improve heat conduction efficiency from the heat conducting member 27 to the fixing belt 22 and to more efficiently heat the fixing belt 22.

Although, in the embodiment, a case where the connecting part 43 connects the right end part (the end part at the upstream side from the fixing nip 34) of the reflecting part 42 and the right end part (the end part at the upstream side from the fixing nip 34) of the nip forming part 44 was described, in another embodiment, the connecting part 43 may be configured to connect a left end part (an end part at the downstream side from the fixing nip 34) of the reflecting part 42 and a left end part (an end part at the downstream side from the fixing nip 34) of the nip forming part 44.

Although, in the embodiment, a case of using the halogen lamp as the heater 26 (the heating source) was described, in another embodiment, a ceramic heater or the like may be used as the heater 26 (the heating source).

Although, in the embodiment, the base material layer of the fixing belt 22 was made of the metal, in another embodiment, the base material layer of the fixing belt 22 may be made of resin.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably;

a pressuring member arranged outside the fixing belt and coming into pressure contact with the fixing belt to form a fixing nip;

a heating source arranged inside the fixing belt to emit radiant heat;

a heat conducting member coming into contact with an inner circumference face of the fixing belt and absorbing the radiant heat emitted from the heating source;

a reflecting member including a reflecting part reflecting the radiant heat emitted from the heating source toward the heat conducting member, a nip forming part unified with the reflecting part and coming into contact with the inner circumference face of the fixing belt to press the fixing belt to a side of the pressuring member, and a connecting part connecting an end part of the reflecting part and an end part of the nip forming part;

a supporting member supporting the nip forming part; and a heat insulating member interposed between the nip forming part and the supporting member, wherein the supporting member and the heat insulating member are stored in a space partially covered by the reflecting part, the nip forming part and the connecting part, the space being opened to a downstream side from the fixing nip in a rotating direction of the fixing belt, wherein the heat conducting member is arranged so that one end part at an upstream side from the fixing nip in the rotating direction of the fixing belt is closer to the fixing nip than another end part at the downstream side from the fixing nip in the rotating direction, the reflecting part is inclined so as to be gradually close to the fixing nip from the downstream side from the fixing nip to the upstream side from the fixing nip in the rotating direction.

2. The fixing device according to claim 1, wherein the reflecting member further includes a folded part folded from an end part at a side separating from the connecting part of the nip forming part to an internal diameter side.

3. The fixing device according to claim 1, wherein the heat conducting member has a storage space storing the heating source and the storage space has an opening part opened to a side of the fixing nip, the reflecting part is arranged so as to cover the opening part.

4. A fixing device comprising:

a fixing belt arranged rotatably;

a pressuring member arranged outside the fixing belt and coming into pressure contact with the fixing belt to form a fixing nip;

a heating source arranged inside the fixing belt to emit radiant heat;

a heat conducting member coming into contact with an inner circumference face of the fixing belt and absorbing the radiant heat emitted from the heating source;

a reflecting member including a reflecting part reflecting the radiant heat emitted from the heating source toward the heat conducting member, a nip forming part unified with the reflecting part and coming into contact with the inner circumference face of the fixing belt to press the fixing belt to a side of the pressuring member, and a connecting part connecting an end part of the reflecting part and an end part of the nip forming part;

a supporting member supporting the nip forming part; and a heat insulating member interposed between the nip forming part and the supporting member, wherein the supporting member and the heat insulating member are stored in a space partially covered by the reflecting part, the nip forming part and the connecting part, the space being opened to a downstream side from the fixing nip in a rotating direction of the fixing belt, wherein the heat conducting member includes:

a curved part curved to a side separating from the fixing nip in an arc-like shape and coming into contact with the inner circumference face of the fixing belt; and bent parts bent from both end parts of the curved part to an internal diameter side.

5. The fixing device according to claim 4, wherein both end parts of the reflecting part are respectively faced to the bent parts at distances.

6. An image forming apparatus comprising:

a fixing device, wherein the fixing device includes:

a fixing belt arranged rotatably;

a pressuring member arranged outside the fixing belt and coming into pressure contact with the fixing belt to form a fixing nip;

a heating source arranged inside the fixing belt to emit radiant heat;

a heat conducting member coming into contact with an inner circumference face of the fixing belt and absorbing the radiant heat emitted from the heating source;

a reflecting member including a reflecting part reflecting the radiant heat emitted from the heating source toward the heat conducting member, a nip forming part unified with the reflecting part and coming into contact with the inner circumference face of the fixing belt to press the fixing belt to a side of the pressuring member, and a connecting part connecting an end part of the reflecting part and an end part of the nip forming part;

a supporting member supporting the nip forming part; and a heat insulating member interposed between the nip forming part and the supporting member, wherein the supporting member and the heat insulating member are stored in a space partially covered by the reflecting part, the nip forming part and the connecting part, the space being opened to a downstream side from the fixing nip in a rotating direction of the fixing belt, wherein the heat conducting member is arranged so that one end part at an upstream side from the fixing nip in the rotating direction of the fixing belt is closer to the fixing nip than another end part at the downstream side from the fixing nip in the rotating direction, the reflecting part is inclined so as to be gradually close to the fixing nip from the downstream side from the fixing nip to the upstream side from the fixing nip in the rotating direction.

7. The image forming apparatus according to claim 6, wherein the reflecting member further includes a folded part folded from an end part at a side separating from the connecting part of the nip forming part to an internal diameter side.

8. The image forming apparatus according to claim 6, wherein the heat conducting member has a storage space storing the heating source and the storage space has an opening part opened to a side of the fixing nip, the reflecting part is arranged so as to cover the opening part.

9. The image forming apparatus according to claim 6, wherein the heat conducting member includes:

a curved part curved to a side separating from the fixing nip in an arc-like shape and coming into contact with the inner circumference face of the fixing belt; and bent parts bent from both end parts of the curved part to an internal diameter side.

10. The image forming apparatus according to claim 9, wherein both end parts of the reflecting part are respectively faced to the bent parts at distances.

* * * * *